United States Patent [19]

Albus

[11] 4,226,027

[45] Oct. 7, 1980

[54] MATERIAL FEED SYSTEM FOR JET MILLS AND FLASH DRYERS

[75] Inventor: James F. Albus, Newtown, Pa.

[73] Assignee: Aljet Equipment Company, Willow Grove, Pa.

[21] Appl. No.: 24,249

[22] Filed: Mar. 27, 1979

[51] Int. Cl.[3] ..... F26B 17/00

[52] U.S. Cl. ..... 34/57 R; 34/10; 34/57 E

[58] Field of Search ..... 34/10, 57 R, 57 E

[56] References Cited

U.S. PATENT DOCUMENTS

| | | | |
|---|---|---|---|
| 3,329,418 | 7/1967 | Stephanoff | 34/57 E |
| 4,062,128 | 12/1977 | Bledsoe | 34/57 R |

*Primary Examiner*—John J. Camby

*Attorney, Agent, or Firm*—George A. Smith, Jr.

[57] ABSTRACT

The expenditure of energy required to feed solid material into a jet mill or flash dryer is significantly reduced by the use of a novel feed system in which a blower, operating at a pressure slightly higher than the pressure within the jet mill or flash dryer, produces a stream of air which transports the solid material to be treated. Solid material is introduced into the stream of air through a rotary valve in which the rotary element is disposed for rotation about an axis parallel to the direction of air flow and its blades move through the path of air flow to prevent the accumulation of material on the blades.

2 Claims, 3 Drawing Figures

MATERIAL FEED SYSTEM FOR JET MILLS AND FLASH DRYERS

SUMMARY OF THE INVENTION

This invention relates to improvements in feed systems applicable to all types of jet mills and flash dryers, and particularly to a novel feed system having low energy requirements.

A typical jet mill is described in U.S. Pat. No. 3,360,870, dated Jan. 2, 1968. This jet mill comprises a conduit arranged in a closed loop and having a series of nozzles in its periphery arranged to introduce air, steam or other gas into the conduit to produce a recirculating flow. Solid matter to be treated is introduced into the mill through a controllable feed device. Particles are removed from the mill after treatment through an opening which is positioned in such a way that centrifugal separation takes place, the smaller, lighter particles being carried out of the mill through the opening along with gas, and the heavier particles being recirculated for further treatment. Flash dryers having configurations similar to those shown in U.S. Pat. No. 3,360,870 are also well known. Another form of jet mill is the type having a circular grinding chamber with gas nozzles located at the periphery of the chamber. A typical example of a mill of this type is described in U.S. Pat. No. 3,348,779, dated Oct. 24, 1967.

Various types of feed devices are used for the introduction of solid matter to be treated into these jet mills and flash dryers. In general, the internal pressure in these mills and dryers is somewhat higher than atmospheric, and the feed device must therefore be designed to overcome the internal pressure, since otherwise it would be impossible to introduce solid material. The most commonly used feed devices include venturi feeders, screw conveyors and rotary valves.

In a venturi feeder, which is the type of feeder most commonly used, a high velocity stream of air is used to produce a vacuum in order to draw the solid material to be treated into the interior of the mill or dryer. Venturi feeders are generally effective, but are subject to a number of problems, the most significant of which is the relatively high energy requirement for their proper operation. A typical venturi feed system consumes between 200 and 500 cfm of air (under ambient conditions) and frequently operates at a pressure close to 100 psig. The operation of the venturi, therefore, requires a relatively large amount of power, typically between 40 and 100 horsepower. Venturi feeders also produce a large amount of noise, and therefore give rise to undesirable working conditions. In addition, a venturi feeder inherently has a restriction in the path flow of the solid material, and is subject to clogging requiring frequent shutdown and cleaning. Clogging is especially likely to occur in a venturi feeder handling damp or wet materials, as these materials frequently "plaster out", i.e. they adhere to and build up on the internal walls and other parts of the venturi assembly.

Screw conveyors are not altogether satisfactory, since they operate by virtue of the continuous presence of a plug of material to be treated, which functions to prevent the pressure within the mill or dryer from causing material to be blown back through the screw. If the plug of material fails for any reason, the system must be shut down, and the plug reestablished. In fact, many raw feed materials such as pellets and granular or lumpy materials, due to their texture and shape, will not form an effective plug.

Rotary valves have also been used, as illustrated by U.S. Pat. No. 3,403,451, dated Oct. 1, 1968. Rotary valves are generally satisfactory for the introduction of non-sticky materials into the circulating high velocity gas streams in jet mills and flash dryers. However, it has been recognized that they are not, by themselves, suitable for use with tacky materials, as such materials tend to accumulate on the blades of a rotary valve and prevent its proper operation. In U.S. Pat. No. 3,403,451, for example, auxiliary jet nozzles connected to a source of high pressure fluid are mounted on the valve housing to inject the high pressure fluid, for example air, against the valve blades in order to clean them of adhering tacky substances. Here, the high pressure jets can require a substantial expenditure of energy, so that the operation of the apparatus using a rotary valve instead of a venturi feeder does not greatly reduce the overall energy requirements of the apparatus.

From the foregoing, it will be appreciated that venturi feed systems require substantial expenditures of energy for their proper operation, and that rotary valve systems have not in the past provided a satisfactory alternative to the venturi as an effective feeder in the case of milling or drying tacky materials.

In accordance with this invention, a rotary blow-through pneumatic feeder is used. Feeders of this type are well-known and have been used in the past for introducing powdered and granular materials into air streams for pneumatic conveying. Even though rotary blow-through feeders have been available for a number of years, to the best of my knowledge, no such feeders have been used in the past for introducing materials into jet mills and flash dryers; and the venturi feeder, despite its shortcomings, is still used extensively in the jet milling and flash drying art.

The principal object of the present invention is to provide an effective substitute for a venturi feed system which requires substantially less energy for its operation, but which is not subject to the drawbacks of the screw conveyors and rotary valve feed devices presently in use.

Another important object of the invention is the provision of an effective substitute for a venturi feed system which is relatively quiet in its operation.

Still another object of the invention is the provision of a feed system which is less likely to become clogged by material to be treated than is a venturi feed system.

The present invention utilizes a specially designed feeder comprising a rotary valve. It differs from the rotary valve system of U.S. Pat. No. 3,403,451 in several important respects, and in particular in that the blades of the rotating element move into the path of the air stream which conveys the material to be treated into the jet mill or dryer. The stream of air itself keeps the rotary valve blades free of accumulated solid material. More specifically, the milling or drying system in accordance with the invention comprises a first conduit, means producing a high-velocity flow of gas in said first conduit for effecting treatment of solid particles therein and an opening in the wall of the first conduit for the introduction of solid matter to be treated; blower means for producing a flow of air under a pressure higher than the pressure at said opening resulting from the flow of gas in said first conduit; means providing a second conduit connected at one of its ends to said blower means to receive air therefrom; feeder means for introducing solid material to be treated into said first conduit through said opening, said feeder means comprising means providing a chamber, means providing an air inlet opening in said chamber connected to the other end of said second conduit, means providing a material inlet opening for introducing solid material into said chamer, and means providing an outlet opening, airlocked conveying means for conveying solid material to be treated into said chamber and preventing continuous flow of air from said air inlet opening outwardly from said chamber through said material inlet opening, said airlocked conveying means comprising a series of movable blades and means for moving said blades to effect movement of solid material into said chamber, said blades being positioned so that, through at least part of its travel, at least a portion of each blade is located in the path of flow of air between said air inlet opening and said outlet opening; and means providing a third conduit connected to receive air and solid material from said outlet opening and to deliver the same to the opening in the wall of the first conduit.

The details of the improved feeder, as well as other objects of the invention, will be apparent from the following detailed description when read in conjunction with the drawings.

DETAILED DESCRIPTION

Figure 1:
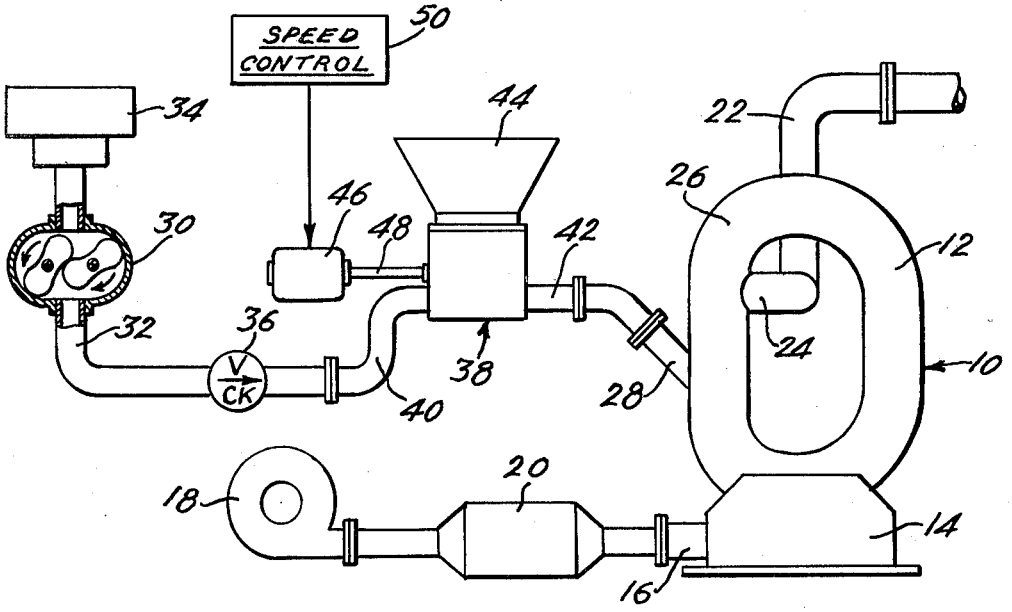
FIG. 1 is a schematic diagram of a flash dryer equipped with an improved material feed system in accordance with the invention.

Flash dryer 10 comprises a conduit 12 arranged in a closed loop as shown. At the bottom of the loop a manifold 14 delivers gas into the loop through a series of nozzles (not shown) which are directed to produce a counterclockwise flow within the loop. Gas (normally air) is supplied to the manifold through manifold inlet 16 from a low pressure high volume blower 18 followed by a heater 20. The heater is typically a gas or oil-fired heater, although other sources of heat, such as steam, can be used. Where steam is used as the heat source, a conventional heat exchanger is used to transfer the heat of the steam to the gas entering the dryer.

Gas is exhausted from the loop through conduit 22, which is in communication with the interior of the loop at location 24, which follows a curved classifier section 26, and is directed toward the interior of the loop. A centrifugal separation takes place within the classifier section so that wet solid particles are recirculated in the loop while dry particles, which are lighter, are carried out through conduit 22 along with the gas stream. Conduit 22 typically leads to a cyclone separator, bag collector of another collection device for separating solid material from the gaseous drying medium. Solid material to be treated is introduced into the loop through an inlet conduit 28, which preferably precedes the gas nozzles in the direction of recirculating flow, but follows outlet location 24. Material inlet 28 is desirably directed obliquely downwardly to prevent material from travelling directly from the inlet to the outlet without being treated. The oblique inlet is commonly accepted as the most desirable form of inlet for injection of material into the dryer conduit.

A conventional jet mill is similar in configuration to dryer 10, and differs from dryer 10 primarily in that the gas inlet nozzles are designed for high pressure to produce a maximum grinding action by collision of particles with each other.

The gas pressure within a loop dryer or jet mill is typically slightly above atmospheric, e.g. up to two or three pounds psig. This pressure appears at inlet 28, and must be overcome in order to introduce material to be treated into the interior of the conduit. As mentioned above, the introduction of material to be treated is normally accomplished by means of a venturi feeder, and occasionally by means of a screw conveyor or rotary valve.

In the system of FIG. 1, air is supplied through a blower 30 capable of producing a pressure at its outlet which is just sufficient to overcome the back pressure at inlet 28. For example, if the back pressure at inlet 28 is one pound, blower 30 should be designed to supply a slightly higher pressure, e.g. 3.5 to 4 pounds at its outlet 32. Blower 30 is preferably a positive displacement rotary lobe blower such as a Roots or Sutorbilt blower.

Air enters blower 30 through an air cleaner 34, and is delivered through a one-way valve 36 to feed device 38. Feed device 38 has an offset air inlet conduit 40, and an outlet conduit 42 which is connected in communication with dryer inlet 28. A material hopper is provided at 44, and a feed control motor 46 is connected to feeder 38 through shaft 48. Motor 46 is of the variable speed type, and is controlled by a conventional speed control 50.

Figure 2:
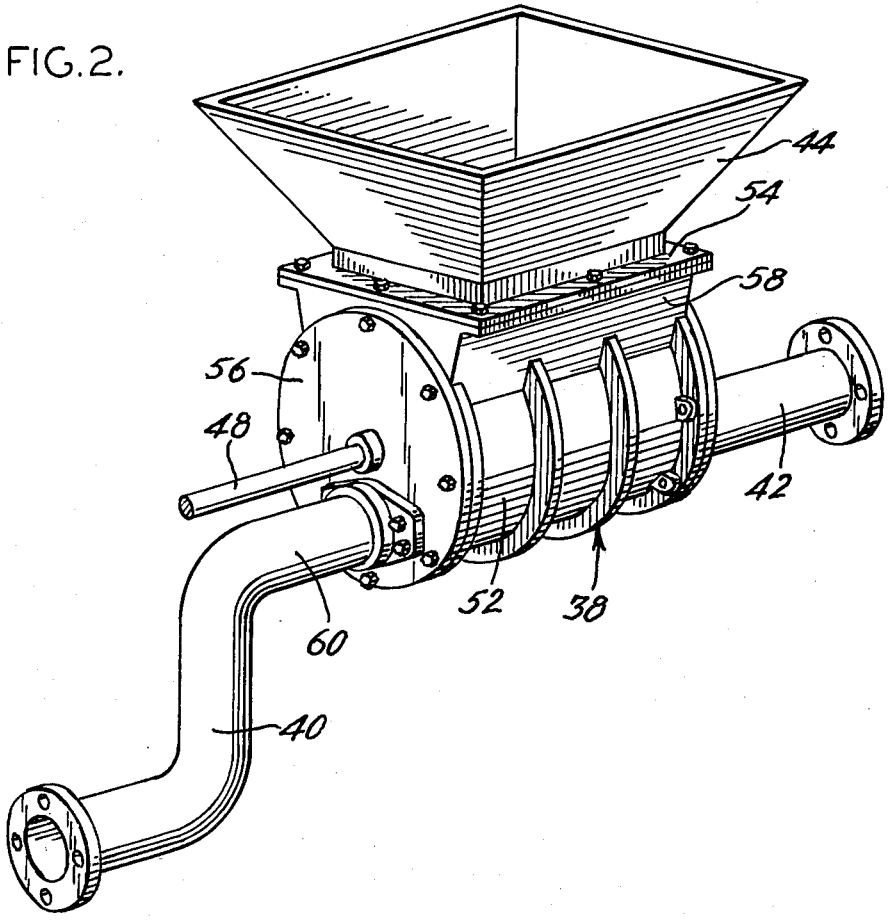
FIG. 2 is an oblique perspective view showing the exterior of a blow-through rotary valve feeder in accordance with the invention.

As shown in FIG. 2, feed device 38 comprises a chamber enclosed by a side wall 52 in the form of a circular cylinder, a cover 54, an end wall 56, and a similar end wall at the opposite end of the cylinder. Cover 54 is located a short distance above the cylinder, a vertically extending wall being provided at 58.

Conduit 40 is offset as shown to allow clearance for the motor driving shaft 48. Conduit 42, and the upper section 60 of conduit 40 are aligned with each other along an axis which is located directly below the axis of cylindrical side wall 52, and shaft 48 is aligned with the axis of the cylindrical side wall.

Figure 3:
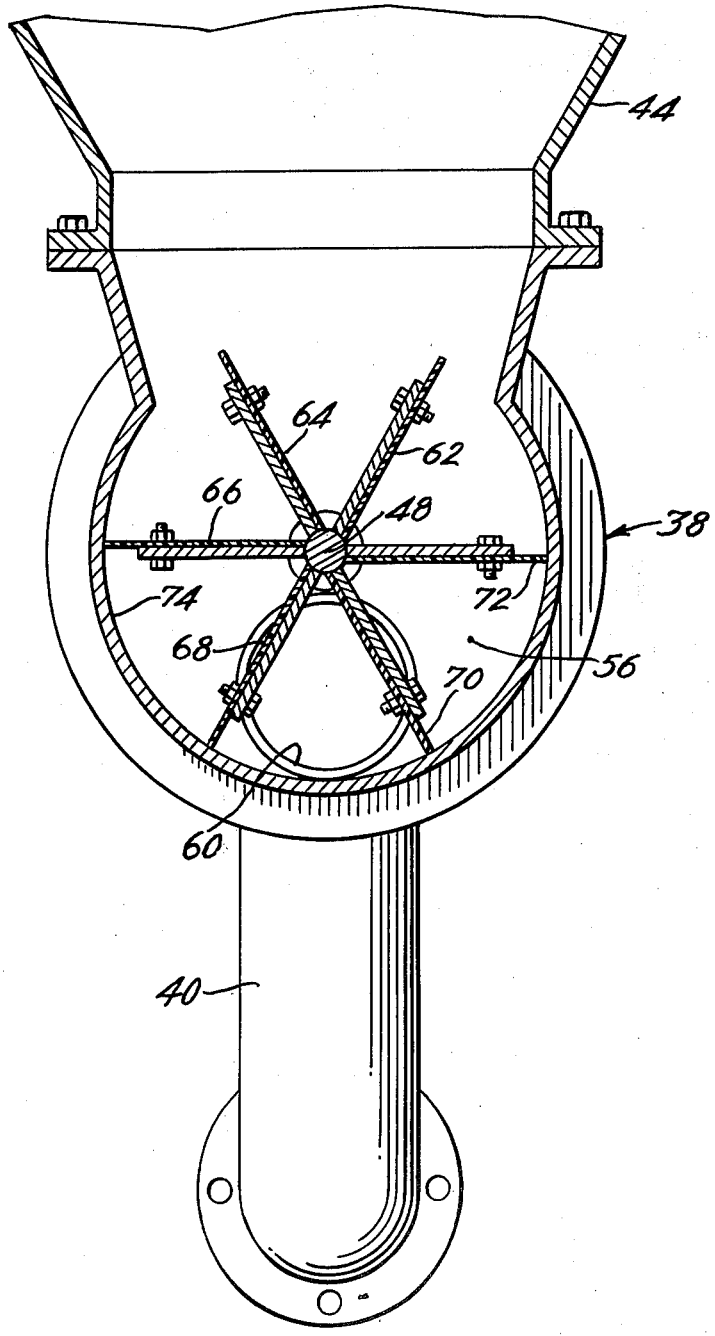
FIG. 3 is a transverse vertical section taken through the rotary valve feeder.

As shown in FIG. 3, within the chamber of feed device 38, shaft 48 is provided with an array of radially extending replaceable blades 62, 64, 66, 68, 70 and 72. These blades extend in the axial direction from one end wall to the other, and in the radial direction from shaft 48 to the cylindrical inner wall 74 of the chamber. With the blades in the position shown in FIG. 3, blades 66 and 72 prevent direct communication between hopper 44 and the lower portion of the chamber. At the same time, conduits 40 and 42 are in continuous communication with each other through the lower porion of the chamber. While various arrangements of blades can be used, the blades must be so arranged as to prevent direct communication between the lower portion of the chamber and the lower opening of the hopper, and at the same time permit continuous communication between the air inlet conduit 40 and outlet conduit 42. As shaft 48 rotates, the blades carry material from the hopper to the lower portion of the chamber, where the material is carried into conduit 42 by the air stream delivered through the chamber from conduit 40.

As shown in FIG. 3, as shaft 48 rotates, substantially the entirety of each blade is exposed to the flow of air between the air inlet opening in end wall 56 and the outlet opening in the opposite end wall. The flow of air between conduits 40 and 42 cleans the blades as they pass the openings of these conduits, eliminating the accumulation of material on the blades which could otherwise occur. Significantly, the blades are kept clean by the same flow of air which transports the material to be treated into conduit 42.

While the blades are desirably arranged with respect to the conduit apertures so that substantially the entirety of each blade is exposed to the flow of air through feed device 38, it is possible to deviate from this ideal condition somewhat by arranging the conduits with respect to the blades so that only a portion of each blade is exposed to the flow of air in each rotation of shaft 48. So long as a substantial portion of the blade is cleaned by the flow of air, the feed device will limit the accumulation of tacky materials on the blades, and continue to operate. Nevertheless, it is desirable to arrange the blades and conduit openings as shown to eliminate substantially all possible accumulation of material on the blades.

Interior wall 74 need not be cylindrical, and the interior surfaces of the end walls need not be flat. However, since the blades are rotated by a shaft, these interior surfaces must be in the form of surfaces of revolution conforming to the contours of the blade edges.

While the surfaces of the blades need not be located in planes which are parallel to the axis of shaft 48, they are preferably so arranged in order to maximize the exposure of the blade surfaces to the flow of air between conduits 40 and 42.

In order to improve the continuous cleaning of the rotating blades, the blades are preferably coated with a polymer, such as PTFE, to which materials cannot readily adhere. Alternatively the removable blade elements can be made entirely of PTFE or a similar material.

In the operation of the system, material to be treated is placed in hopper 44, and is fed into the dryer or jet mill by the simultaneous operation of motor 46 and blower 30. The rate at which material is fed can be controlled by speed control 50. The power required to operate this feed device is in the vicinity of 1/7 of the power required to operate a venturi-type feed device having a similar capacity. The saving in power is especially important where extremely large volumes of material are to be treated, for example in the drying of municipal sewage sludge. Especially in the case of the treatment of sludge and other tacky materials, the feed apparatus of the present invention has the additional advantage that it operates reliably and resists clogging without requiring large amounts of power for its operation.

I claim:

1. In a jet mill or flash dryer comprising a first conduit, means producing a high-velocity flow of gas in said first conduit for effecting treatment of solid particles therein and an opening in the wall of said first conduit for the introduction of solid matter to be treated, a material feed system comprising:

blower means for producing a flow of air under a pressure higher than the pressure at said opening resulting from the flow of gas in said first conduit;

means providing a second conduit connected at one of its ends to said blower means to receive air therefrom;

feeder means for introducing solid material to be treated into said first conduit through said opening, said feeder means comprising means providing a chamber, means providing an air inlet opening in said chamber connected to the other end of said second conduit, means providing a material inlet opening for introducing solid material into said chamber, and means providing an outlet opening, airlocked conveying means for conveying solid material to be treated into said chamber and preventing continuous flow of air from said air inlet opening outwardly from said chamber through said material inlet opening, said airlocked conveying means comprising a series of movable blades and means for moving said blades to effect movement of solid material into said chamber, said blades being positioned so that, through at least part of its travel, at least a portion of each blade is located in the path of flow of air between said air inlet opening and said outlet opening; and means providing a third conduit connected to receive air and solid material from said outlet opening and to deliver the same to said opening in the wall of said first conduit;

in which said means comprising a series of blades is a rotary valve having a rotatable shaft, and in which said chamber is bounded in part by a pair of end walls, and a side wall in the form of a surface of revolution coaxial with said shaft and extending between said end walls, said blades being secured to and extending radially outwardly from said shaft and substantially conforming to said end walls and to said surface of revolution, thereby forming a series of movable chambers within said chamber, and in which said air inlet opening is in one of said end walls, said outlet opening is in the other of said end walls, and said material inlet opening is formed by a gap in said side wall, and said blades are sufficient in number to prevent direct communication between said material inlet opening and said air inlet opening and between said material inlet opening and said outlet opening regardless of the position of said rotatable shaft, and in which said air inlet opening and said air outlet opening are positioned in said opposite end walls for continuous communication between them through said movable chambers.

2. Apparatus according to claim 1 in which said air inlet opening and said outlet opening are aligned with each other and extend radially from a position adjacent said rotatable shaft to a position adjacent the maximum radial extent of said surface of revolution, whereby, in the course of a full revolution of said rotatable shaft, substantially the entirety of each blade is exposed to the flow of air between said air inlet opening and said outlet opening.

* * * * *